US007347833B2

(12) United States Patent
Kim

(10) Patent No.: US 7,347,833 B2
(45) Date of Patent: Mar. 25, 2008

(54) METHOD FOR MASSAGING A BODY LYING ON A LIE-DOWN MASSAGER

(76) Inventor: Hakjin Kim, 610 Ridgeview Ct., Diamond Bar, CA (US) 91765

( * ) Notice: Subject to any disclaimer, the term of this patent is extended or adjusted under 35 U.S.C. 154(b) by 0 days.

(21) Appl. No.: 11/382,177

(22) Filed: May 8, 2006

(65) Prior Publication Data

US 2006/0195052 A1 Aug. 31, 2006

Related U.S. Application Data

(63) Continuation of application No. 10/602,098, filed on Jun. 23, 2003, now abandoned.

(51) Int. Cl.
*A61H 15/00* (2006.01)

(52) U.S. Cl. ..... 601/98; 601/15; 601/101; 601/103

(58) Field of Classification Search ..... 601/15, 601/17, 19, 86, 87, 90–95, 97–99, 100–103, 601/115, 116; 607/96, 98
See application file for complete search history.

(56) References Cited

U.S. PATENT DOCUMENTS

| | | | | |
|---|---|---|---|---|
| 5,083,552 | A * | 1/1992 | Lipowitz | 601/84 |
| 5,916,182 | A * | 6/1999 | Fengler | 601/110 |
| 6,643,551 | B1 * | 11/2003 | Park | 607/100 |
| 6,685,659 | B2 * | 2/2004 | Webb | 601/49 |

* cited by examiner

*Primary Examiner*—Quang D. Thanh
(74) *Attorney, Agent, or Firm*—IPLA P.A.; James E. Bame

(57) ABSTRACT

A method for massaging a body lying on a horizontally leveled upper surface portion of a lie-down massager which includes a pressure applying member, comprises the steps of reciprocating the pressure applying member between a first end and a second end of the upper surface portion in accordance with a predetermined longitudinal stroke of the pressure applying member; and the predetermined longitudinal stroke coordinating along a first axis and a second axis in concurrence with the reciprocation so that the pressure applying member moves to follow a predetermined coaxial curve defined by the first axis and the second axis, wherein the first axis is parallel to the upper surface portion, wherein the second axis is perpendicular to the first axis.

26 Claims, 16 Drawing Sheets

METHOD FOR MASSAGING A BODY LYING ON A LIE-DOWN MASSAGER

CROSS REFERENCE

This is a continuation application of Ser. No. 10/602,098, filed Jun. 23, 2003 now abandoned

BACKGROUND OF THE INVENTION

The invention relates to a method for massaging a human body. More particularly, the present invention relates to an improved method for massaging a human body lying on a lie-down massager, capable of efficiently treating bodily malfunctions such as pains related to the backbone and muscles in vicinity of the backbone, blood circulation troubles, and gastrointestinal weakness, etc. by providing acupressure movement and heat treatment to relevant points of a human body.

Conventional bed or mat type massage devices provide basic reciprocating motions of massage bumps, which apply pressure on the body of a patient, along the body. The massage devices of prior art have a disadvantage that it cannot provide massaging that considers detailed curvatures of various patients. Each human being has a different height, weight and body surface curvature. However, massage devices of prior art provide a simple linear massage motion or modified by a simple jig that resembles the curve of a human backbone. Springs, cushions or links were used to accommodate the deviations from the simple reciprocating massage motion. However, such means did not effectively provide therapeutic massage effect, or acupressure. Further, due to rough massaging motions of massage bumps, which do not accommodate precise human body shapes, pains were induced to the user of the massage devices.

Also, there are medically important points on the human body, on which heating and acupressure treatment should be concentrated. While the positions of the points and intensity of treatments are different from patient to patient, conventional massage devices did not provide customized massaging motion that is controllable to meet such requirements. A massage method and a massage apparatus providing accurate massaging movement for effective massage and acupressure treatment have been in demand for a long time.

SUMMARY OF THE INVENTION

The present invention is contrived to overcome the conventional disadvantages. Accordingly, an object of the invention is to provide a method and an apparatus for massaging human body that can provide massaging motion adapted to different height and width of individual human bodies.

Another object is to provide a method and an apparatus for massaging human body that can provide three-dimensional massaging motions.

A further object is to provide a method and an apparatus for massaging human body in which a user can adjust or customize details of massaging motions.

Still further object is to provide a method and an apparatus for massaging human body in which the body contour of a user is measured and memorized in order to provide most effectively customized massaging motion.

To achieve these and other objects, the method for massaging the body of a patient lying on a horizontally leveled upper surface portion of a lie-down massager which includes a pressure applying member, comprises the steps of: reciprocating the pressure applying member between a first end and a second end of the upper surface portion in accordance with a predetermined longitudinal stroke of the pressure applying member; and the predetermined longitudinal stroke coordinating along a first axis and a second axis in concurrence with the reciprocation so that the pressure applying member moves to follow a predetermined coaxial curve defined by the first axis and the second axis, wherein the first axis is parallel to the upper surface portion, wherein the second axis is perpendicular to the first axis.

In a preferred mode, the method for massaging the body of a patient lying on a horizontally leveled upper surface portion of a lie-down massager which includes a pressure applying member, comprises: measuring a body contour of the patient to read a body line abutting with the upper surface portion; reciprocating the pressure applying member between a first end and a second end of the upper surface portion in accordance with a predetermined longitudinal stroke of the pressure applying member, wherein the longitudinal stroke is customized in accordance with the read body line; and the predetermined longitudinal stroke coordinating along a first axis and a second axis in concurrence with the reciprocation so that the pressure applying member moves to follow a predetermined coaxial curve defined by the first axis and the second axis, wherein the first axis is parallel to the upper surface portion, wherein the second axis is perpendicular to the first axis.

Advantages of the present inventions include that: (1) the method and apparatus of the present invention provides massaging and acupressure treatment for precise positions of the human body; (2) the present invention provides comfortable massage feeling to the user by customizing massaging movements for individual users; (3) the present invention maximizes massaging effect by three-dimensional massaging motion; (4) various pre-configured massaging motions are provided and the motions can be further refined by adapting them to the backside contour of the user and customizing detailed massaging motions for important portions of the user's body; (5) the present invention provides relaxation and energy flow enhancement to the energy points, energy paths and nerves connected to or distributed around the spine; (6) the present invention provides effective treatment in recovering crooked or protruded spines to their original shape, and recovering squeezed or worn cartilages; (7) the present invention provides effective treatment in removing excess fat and cholesterol that are deposited in blood vessels; (8) nerve cells are relaxed thereby recovering and expediting functions of internal organs connected to the nerve cells; and (9) the present invention provides continuous, economic and user-friendly massaging and acupressure treatment.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
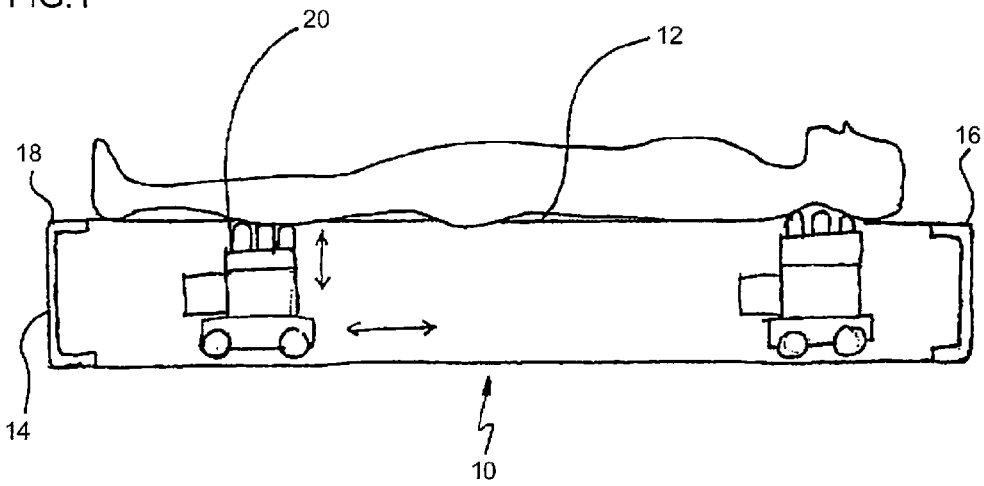
FIG. 1 is a schematic elevation view showing an apparatus for human body massaging with a patient lying thereon according to the first embodiment of the present invention.

With reference to the accompanying drawings, a method for massaging the body of a patient lying on a horizontally leveled upper surface portion 12 of a lie-down massager 10 which includes a pressure applying member 20 will now be explained. The method comprises the steps of reciprocating the pressure applying member 20 between a first end 16 and a second end 18 of the upper surface portion 12 in accordance with a predetermined longitudinal stroke of the pressure applying member 20; and the predetermined longitudinal stroke coordinating along a first axis X and a second axis Y in concurrence with the reciprocation so that the pressure applying member 20 moves to follow a predetermined coaxial curve defined by the first axis X and the second axis Y, wherein the first axis X is parallel to the upper surface portion 12, wherein the second axis Y is perpendicular to the first axis X.

The coaxial curve may be selected from a plurality of teeth waves, parabolic waves, sinusoidal waves, and roller waves. Here, the waves each start anew per a predetermined distance along the first axis. The coaxial curve includes a plurality of convex portions. The movement of the pressure applying member 20 along each of the convex portions repeats a predetermined number of times, wherein the waves each start anew per a predetermined distance along the first axis X.

Meanwhile, the coaxial curve is divided into a plurality of discrete sections, and the pressure applying member selectively applies pressure to the patient at the discrete sections. Also, during the coordinating step, the movement of the pressure applying member 20 along the second axis Y is stopped when the pressure by the pressure applying member 20 reaches a massage pressure threshold, where the massage pressure threshold is adjustable. The pressure applying member 20 may be heated to a predetermined temperature.

Further, during the coordinating step the pressure applying member 20 moves to follow a predetermined width curve defined by the second axis Y and a third axis Z perpendicular to the first axis X and the second axis Y. The pressure applying member 20 comprises one or more movable massage bumps 74, 76 that protrude toward the patient, and the massage bumps 74, 76 move to follow the predetermined width curve.

The pressure applying member 20 further comprises one or more fixed massage bumps 78, 80. The massage bumps may be formed in one or two pairs positioned symmetric to each other at the center of the pressure applying member 20, where the massage bumps move relative to each other to form two width curves parallel to each other. Here, the width curve follows the body contour of the patient.

In a preferred embodiment, the method for massaging the body of a patient lying on a horizontally leveled upper surface portion 12 of a lie-down massager 10 which includes a pressure applying member 20, comprises the steps of measuring a body contour of the patient to read a body line abutting with the upper surface portion 12; reciprocating the pressure applying member between a first end 16 and a second end 18 of the upper surface portion 12 in accordance with a predetermined longitudinal stroke of the pressure applying member, wherein the longitudinal stroke is customized in accordance with the read body line; and the predetermined longitudinal stroke coordinating along a first axis X and a second axis Y in concurrence with the reciprocation so that the pressure applying member moves to follow a predetermined coaxial curve defined by the first axis X and the second axis Y, wherein the first axis X is parallel to the upper surface portion, wherein the second axis Y is perpendicular to the first axis X.

For better performance, the measuring step reads a value of the second axis Y relative to location of the pressure applying member 20 which moves along the first axis X at a constant speed, wherein the pressure applying member 20 moves upward along the second axis until the pressure on the patient by the pressure applying member reaches a threshold.

In this construction, the body contour of the patient is measured by coordinating the second axis Y and the third axis Z where the pressure applying member 20 moves along the third axis at a constant speed relative to the first axis X so the pressure applying member 20 moves toward the patient in the direction of the second axis X until the pressure on the patient by the pressure applying member 20 reaches a threshold.

The coaxial curve and the width curve serve to form a massage surface along which the pressure applying member follows. Also, the coaxial curve includes an acupressure wave incorporating a linear acupressure movement, a convex acupressure movement or both. Selectively, the width curve has a wave of a two-dimensional coil. The threshold may be adjustable.

In further detail, FIG. 1 shows an apparatus 10 or a lie-down massager for massaging a human body. A patient rests on an upper surface portion 12 of a platform 14. The upper surface portion 12 includes a first end 16 and a second end 18. The apparatus 10 includes a pressure applying member 20 that is movable between the first end 16 and the second end 18 for a predetermined longitudinal stroke 1 (refer to FIG. 5) along a first axis X that is parallel to the upper surface portion 12 and longitudinal to the platform 14 and a second axis Y that is perpendicular to the first axis X and to the upper surface portion 12(refer to FIG. 4). The pressure applying member 20 contacts backside of the patient and applies pressure to the patient.

Figure 2:
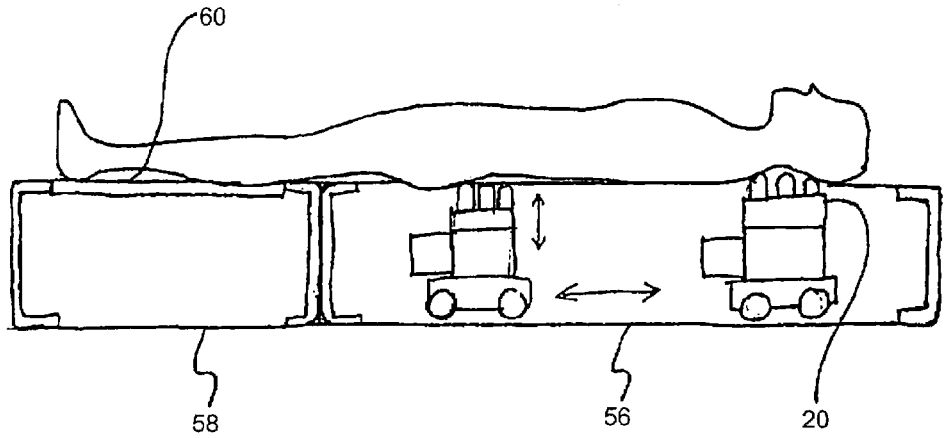
FIG. 2 is a schematic elevation view showing an apparatus for human body massaging with a patient lying thereon according to the second embodiment of the present invention.
Figure 3:
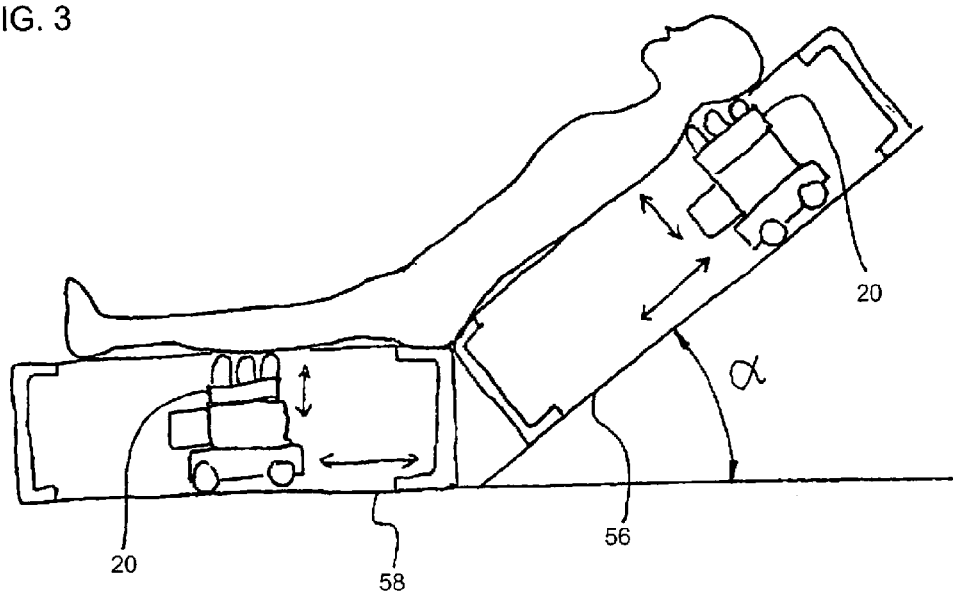
FIG. 3 is a view similar to FIG. 2 but shows that a massaging platform is inclined.

FIG. 2 shows that the platform 14 includes an upper platform 56 and a lower platform 58. The upper platform 56 supports the upper body of the patient, and the lower platform 58 supports the lower body of the patient. FIG. 3 shows that the upper platform 56 makes an angle $\alpha$ with a horizontal surface. The angle $\alpha$ is adjustable by the patient so that the upper platform 56 may be used like a back plate of a chair. FIG. 3 shows that the pressure applying member 20 is also provided in the lower platform 58. FIG. 2 shows that a heating mat 60 instead of the pressure applying member 20 is provided in the lower platform 58.

Figure 28:
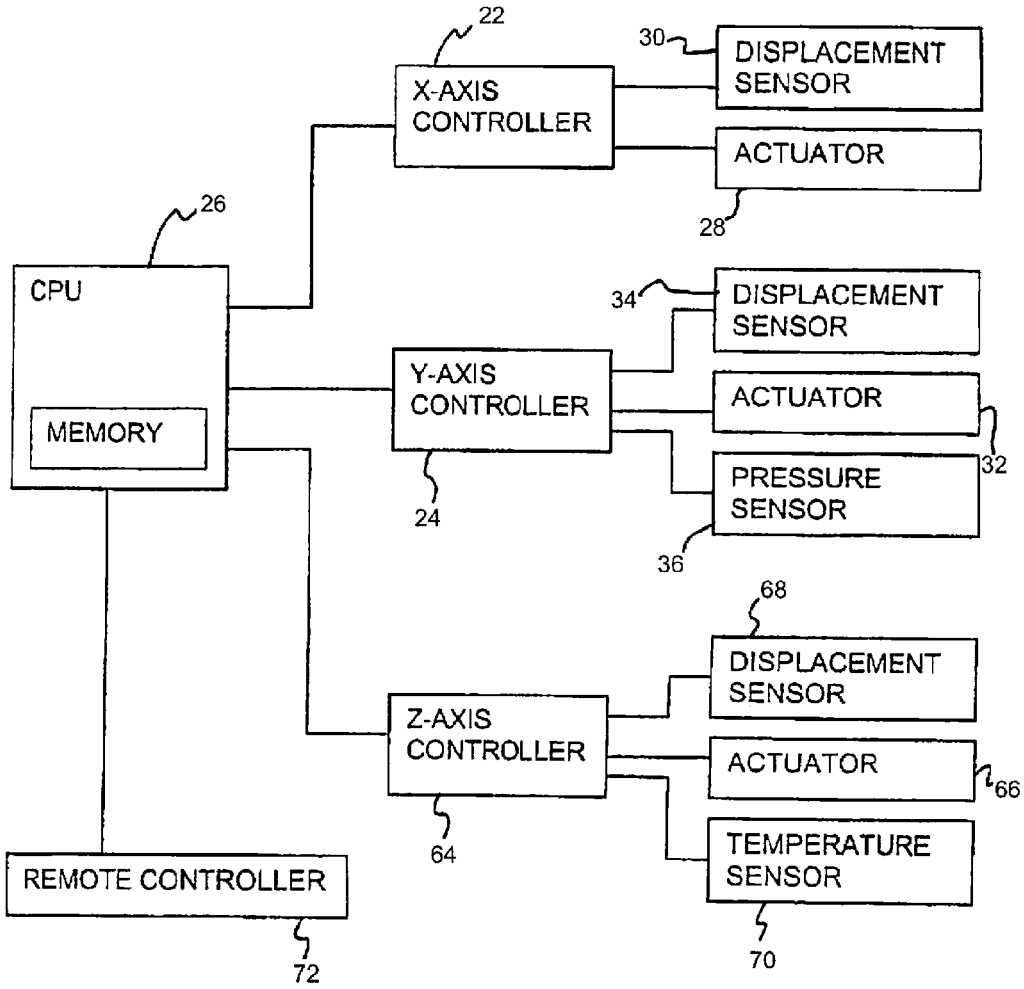
FIG. 28 is a schematic block diagram showing the components of the apparatus for human body massaging.

Referring to FIG. 28, the apparatus 10 further includes a first axis controller 22 that controls movement of the pressure applying member 20 along the first axis X, and a second axis controller 24 that controls movement of the pressure applying member 20 along the second axis Y.

Figure 4:
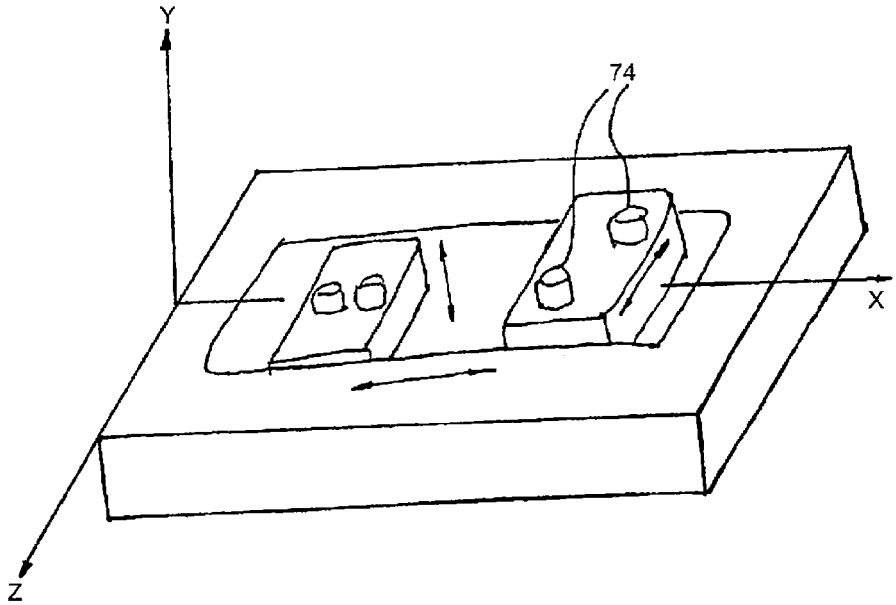
FIG. 4 is a schematic perspective view showing the three-dimensional motion of a pressure applying member in the XYZ space.

The pressure applying member follows a predetermined coaxial curve in the XY plane in FIG. 4. The first axis coordinate of the coaxial curve is defined by a first function of time, and the second axis coordinate of the coaxial curve is defined by a second function of the first axis coordinate. In this way, massaging motion by the pressure applying member 20 may be conveniently defined and controlled with the coaxial curve.

Referring back to FIG. 28, the apparatus 10 further includes a microprocessor 26 that is connected to the first axis controller 22 and the second axis controller 24. The microprocessor 26 stores a plurality of coaxial curves, and the first axis controller 22 and the second axis controller 24 control the movement of the pressure applying member 20 following the coaxial curve selected by the patient.

The first axis controller 22 includes a first axis actuator 28 and a first axis displacement sensor 30. The first axis actuator 28 moves the pressure applying member 20 along the first axis X, and the first axis displacement sensor 30 measures the displacement of the pressure applying member 20 along the first axis X. The second axis controller 24 includes a second axis actuator 32 and a second axis displacement sensor 34. The second axis actuator 32 moves the pressure applying member 20 along the second axis Y, and the second axis displacement sensor 34 measures the displacement of the pressure applying member 20 along the second axis Y. The information provided by the displacement sensors 30, 34 may be used to feedback control the movement of the pressure applying member 20 or to measure the displacement of the pressure applying member 20.

The second axis controller 24 further includes a pressure sensor 36. The pressure sensor 36 measures the pressure applied to the patient by the pressure applying member 20.

During the movement of the pressure applying member 20, the movement of the pressure applying member 20 in the second axis direction is stopped when the pressure applied by the pressure applying member 20 reaches a massage pressure threshold. The massage pressure threshold is adjustable so that massage intensity is controlled.

The body contour of the patient is measured by measuring the second axis coordinate of the pressure applying member 20 while the pressure applying member 20 is moved along the first axis X at a constant speed. The pressure applying member 20 is moved toward the patient in the direction of the second axis Y until the pressure applied on the patient by the pressure applying member 20 reaches a threshold. A curve formed by the measured second axis coordinates and the corresponding first axis coordinates is memorized in the microprocessor 26.

Figure 11:
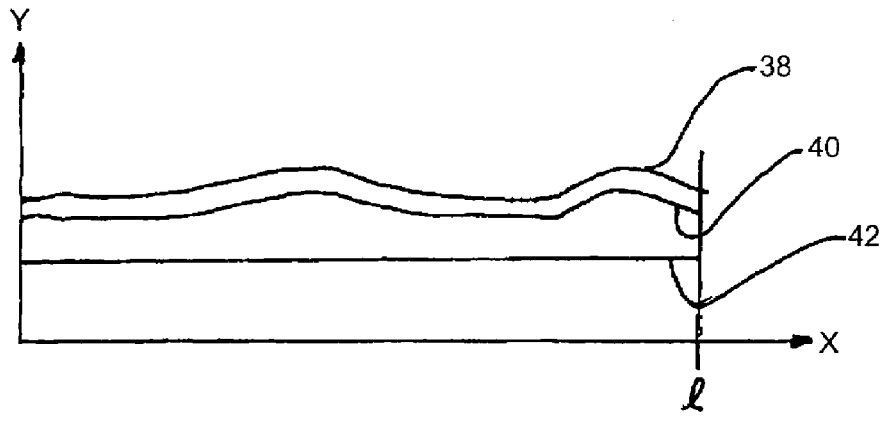
FIG. 11 is a graph showing a curve that indicates the movement of the pressure applying member in XY plane, and the curve follows the backside contour of a human body.

FIGS. 11-17 show various coaxial curves. In FIG. 11, the coaxial curves 38 and 40 follow the backside contour of the patient. The coaxial curve 38, 40 start from 0 on the first axis X, and ends at the longitudinal stroke 1. The coaxial curves 38 and 40 have different starting points or reference points on the second axis Y. The reference point of the second axis Y coordinate of the coaxial curve is adjustable whereby the pressure applied by the pressure applying member 20 is adjustable. The coaxial curve following the body contour is effective in relieving or curing muscular pain after hard exercise, stressed blood vessels, and cold limbs due to retarded blood circulation, etc. Pre-configured coaxial curves are initially stored in the microprocessor 26.

Figure 12:
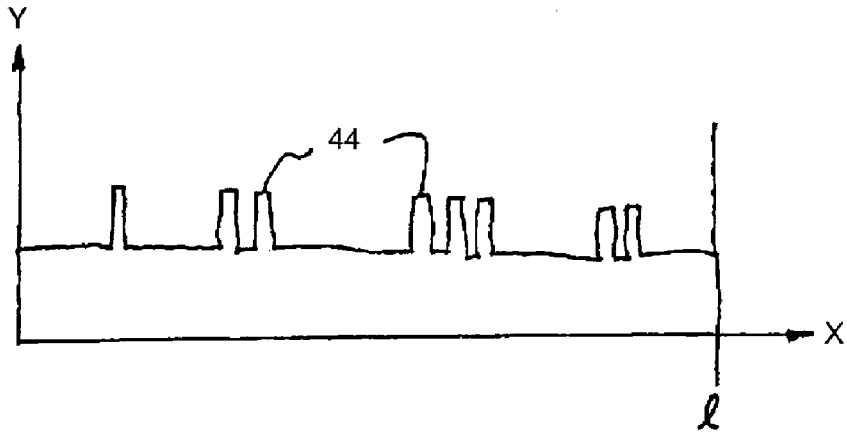
FIG. 12 is a graph showing a curve that indicates the movement of the pressure applying member in XY plane, and the curve includes square acupressure operations.
Figure 27:
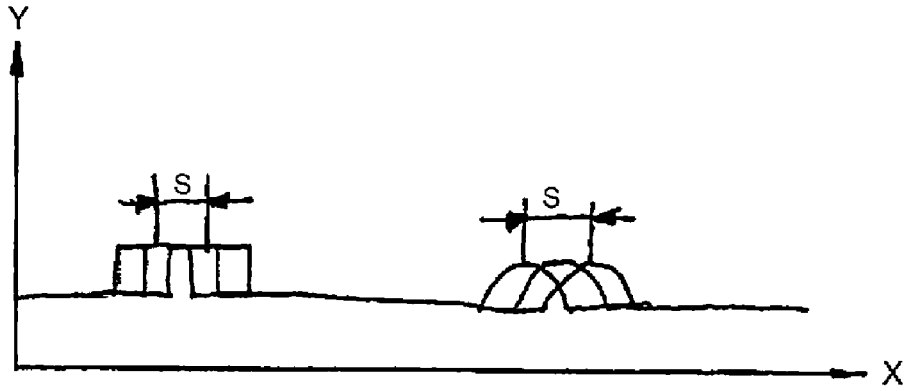
FIG. 27 is a graph showing a curve that indicates the movement of the pressure applying member in XY plane, and the curve shows that a square acupressure operation may be shifted by a predetermined amount, and a convex square acupressure operation may be shifted by a predetermined amount.

In FIG. 12, the coaxial curve includes a plurality of square curves 44 at predetermined first axis X coordinates. The movement of the pressure applying member 20 along each of the square curves 44 may be repeated for a predetermined number of times. That is, acupressure operation by the square curve can be repeated for a certain points of the patient body. Also, as shown in FIG. 27, the starting point of each of the square waves may shift along the first axis X for a predetermined amount s. The coaxial curve including the square waves together with heat treatment by the heater 62 are effective in detailed and localized massaging for the blood vessels, nerves, energy points and energy paths around the backbone. The height of the square wave is about 30 mm.

Figure 13:
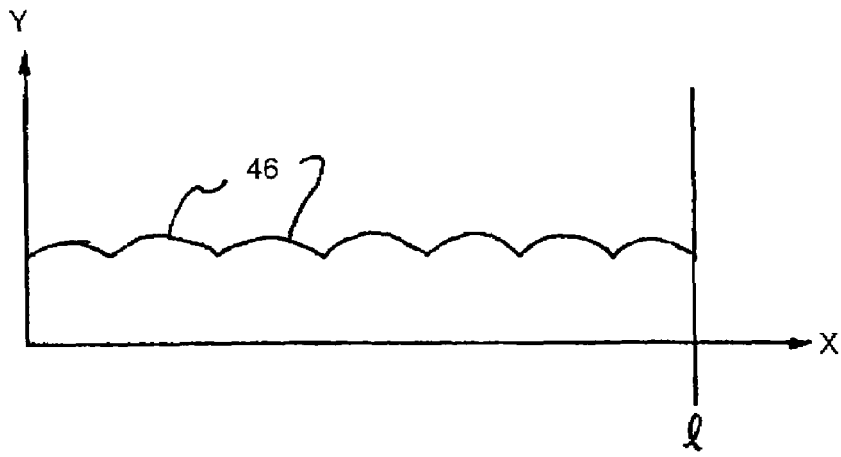
FIG. 13 is a graph showing a curve that indicates the movement of the pressure applying member in XY plane, and the curve includes convex acupressure operations.

In FIG. 13, the coaxial curve includes a plurality of convex portions 46 at predetermined first axis X coordinates. The movement of the pressure applying member 20 along each of the convex portions 46 may be repeated for a predetermined number of times. That is, acupressure operation by the convex portion can be repeated for a certain points of the patient body. Also, as shown in FIG. 27, the starting point of each of the convex portion may shift along the first axis X for a predetermined amount s. The coaxial curve including convex portions provides soft and flexible movement of the backbone. The height of the convex portion is about 10 mm.

Figure 14:
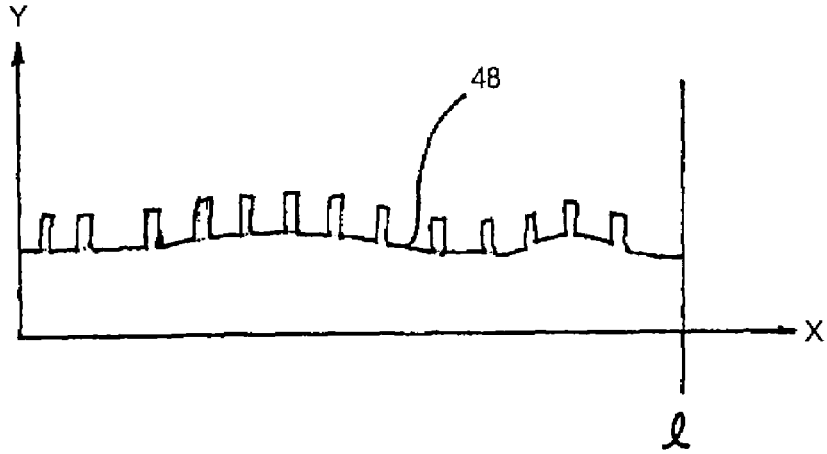
FIG. 14 is a graph showing a curve that indicates the movement of the pressure applying member in XY plane, and the curve follows the backside contour of a human body and includes square acupressure operations.

FIG. 14 shows that the curves shown in FIGS. 11 and 12 are combined. That is, the coaxial curve 48 follows the body contour and includes a plurality of square waves at predetermined first axis X coordinates.

Figure 15:
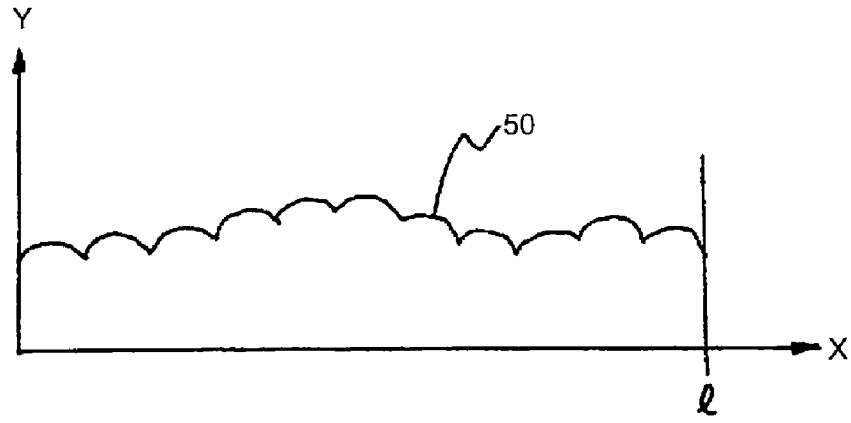
FIG. 15 is a graph showing a curve that indicates the movement of the pressure applying member in XY plane, and the curve follows the backside contour of a human body and includes convex acupressure operations.

FIG. 15 shows that the curves shown in FIGS. 11 and 13 are combined. That is, the coaxial curve 50 follows the body contour and includes a plurality of convex portions at predetermined first axis X coordinates.

Figure 16:
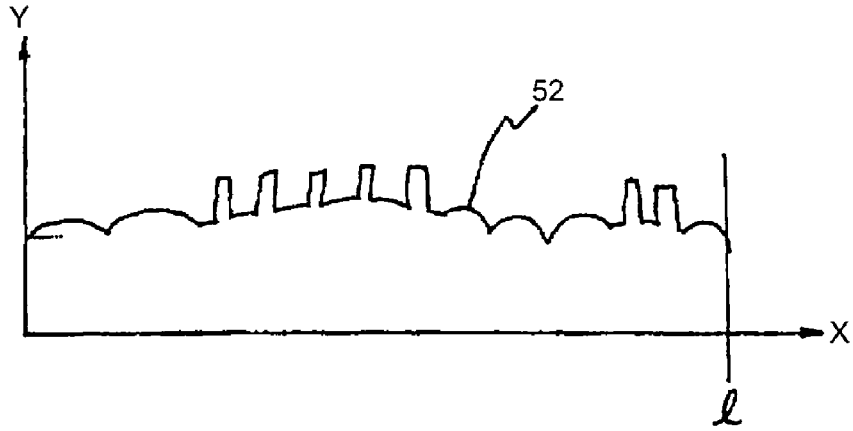
FIG. 16 is a graph showing a curve that indicates the movement of the pressure applying member in XY plane, and the curve follows the backside contour of a human body and includes square and convex acupressure operations.

FIG. 16 shows that the curves shown in FIGS. 11-13 are combined. That is, the coaxial curve 52 follows the body contour and includes a plurality of square curves and a plurality of convex portions at predetermined first axis X coordinates. The square curves and convex portions may be pre-configured or added or removed by the patient.

Figure 17:
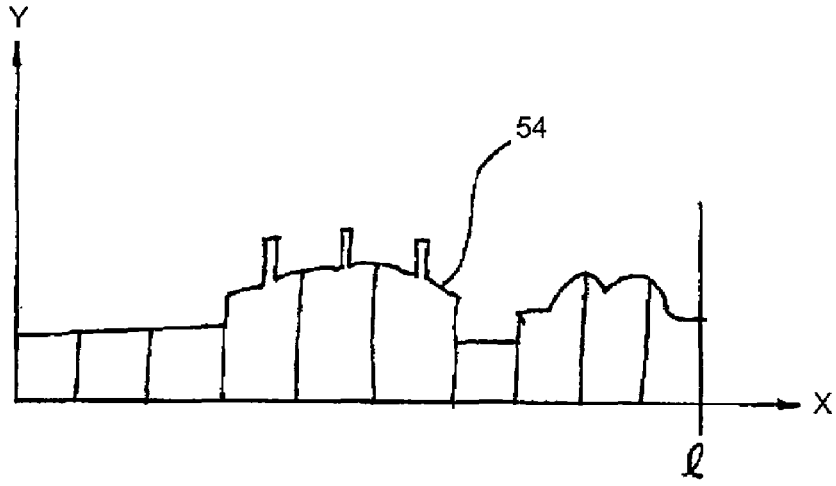
FIG. 17 is a graph showing a curve that indicates the movement of the pressure applying member in XY plane, and the curve is divided into a plurality of sections, and acupressure operations are limited to specific sections.

FIG. 17 shows that the coaxial curve is divided into a plurality of discrete sections 54, and the pressure applying member 20 applies pressure to the patient for selected discrete sections. The selected sections may be pre-configured. The patient also add or remove the sections. This sectioning facilitates manual adjustment of the coaxial curves for a particular patient's need.

Referring back to FIG. 11, the second axis Y coordinate of the coaxial curve 42 has a constant value. The constant value is sufficiently small so that the pressure applying member 20 does not apply pressure to the patient. This curve may be used when quickly returning the pressure applying member 20 backward from the second end 18 to the first end 20 of the platform 14 so that massaging is done in one direction rather in both directions.

The longitudinal stroke 1 is adjustable for a different height of the patient. Then the coaxial curve is adjusted proportional to the longitudinal stroke.

Figure 10:
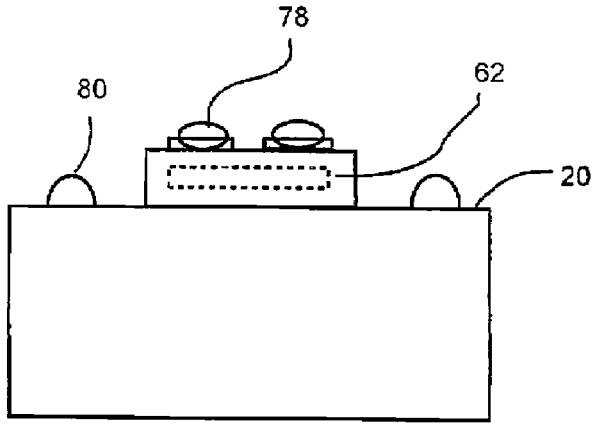
FIG. 10 is a side elevation view of the pressure applying member.
Figure 18:
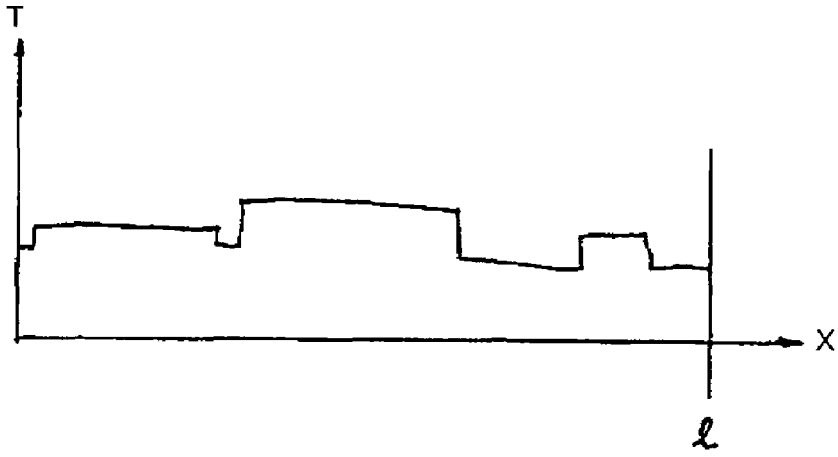
FIG. 18 is a graph showing a curve that indicates temperature variation of the pressure applying member along the X axis.

The pressure applying member 20 includes a heating member 62 as shown in FIG. 10. The temperature of the heating member 62 is controlled as a third function of the first axis X coordinate when the pressure applying member 20 is moved as shown in FIG. 18.

Referring back to FIG. 28, the apparatus 10 further includes a third axis controller 64 that controls movement of the pressure applying member 20 along the third axis Z in FIG. 4. The third axis Z is perpendicular to the first axis X and the second axis Y. The movement of the pressure applying member follows a predetermined width curve in XZ plane. The third axis Z coordinate of the width curve is defined by a fifth function of the first axis coordinate.

The microprocessor 26 is connected to the third axis controller 64. The microprocessor 26 stores a plurality of width curves, and the first axis controller 22 and the third axis controller 64 control the movement of the pressure applying member 20 following the width curve selected by the patient.

The third axis controller 64 includes a third axis actuator 66 and a third axis displacement sensor 68. The third axis actuator 66 moves the pressure applying member 20 along the third axis Z, and the third axis displacement sensor 68 measures the displacement of the pressure applying member 20 along the third axis Z.

The third axis controller 64 further includes a temperature sensor 70. The temperature sensor 70 measures the temperature of the pressure applying member 20.

A remote controller 72 is connected to the microprocessor 26 so that the patient can adjust the height and width curves and other operations of the apparatus 10.

Figure 19:
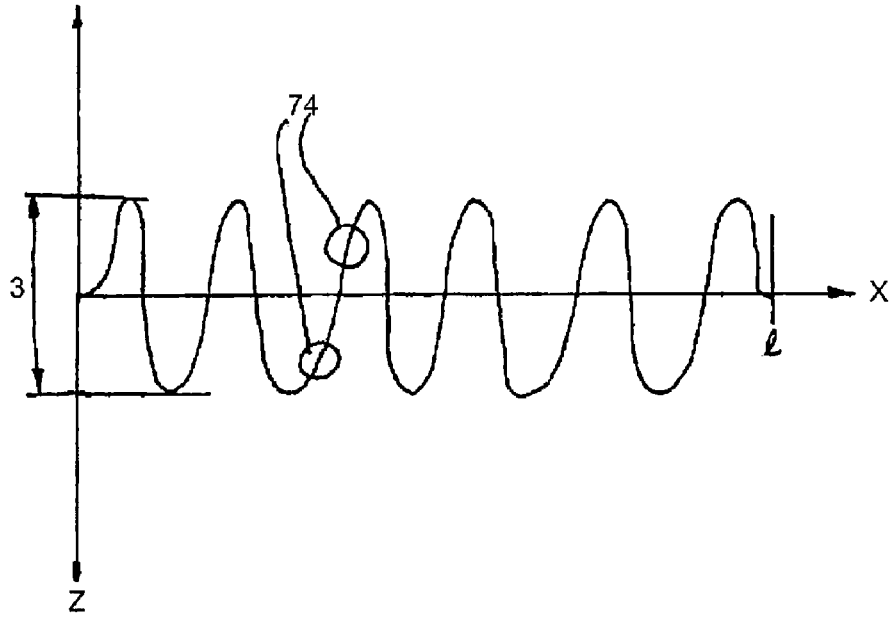
FIG. 19 is a graph showing a curve that indicates the movement of the massage bumps of the pressure applying member in XZ plane, and that the curve is a sine wave, and that two massage bumps follow the same curve.
Figure 20:
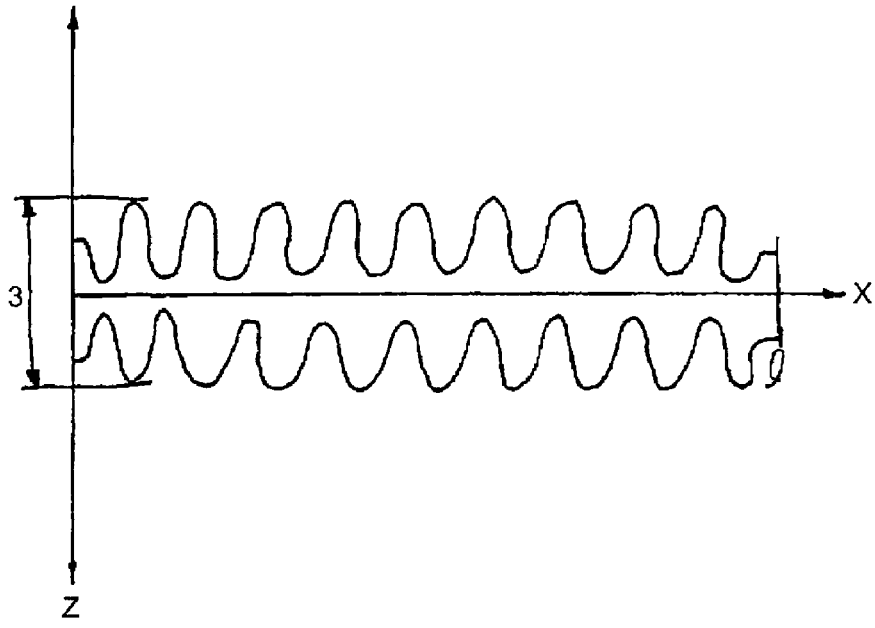
FIG. 20 is a graph showing two curves that indicate the movement of the massage bumps of the pressure applying member in XZ plane, and the curves are sine waves that are parallel to each other.
Figure 21:
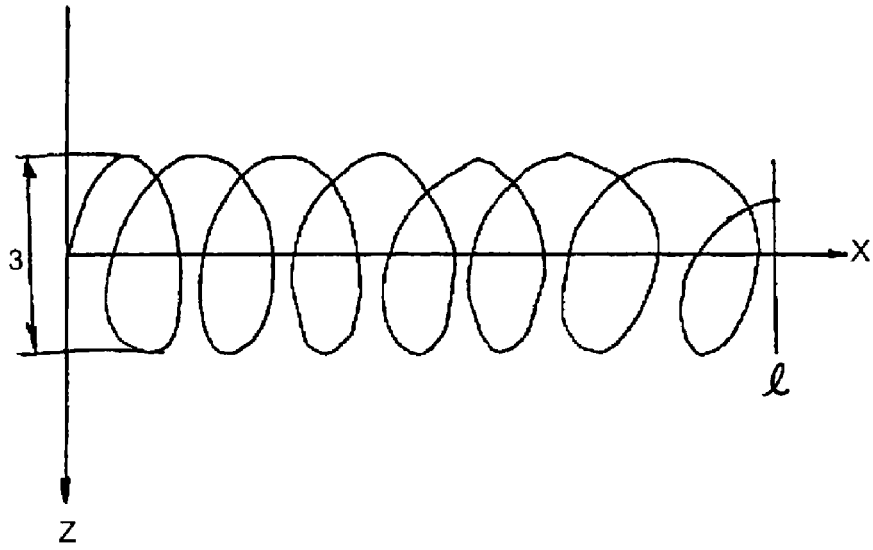
FIG. 21 is a graph showing a curve that indicates the movement of the massage bumps of the pressure applying member in XZ plane, and the curve has a shape of a two-dimensional coil.

FIGS. 19-25 show various width curves. In FIG. 19, the width curve is a sine wave. In FIG. 21, the width curve has a shape of a two-dimensional coil. FIG. 19 also shows that the maximum width of the width curve is the width w in FIG. 4. The width w is adjustable to accommodate varying widths of patient bodies.

Figure 5:
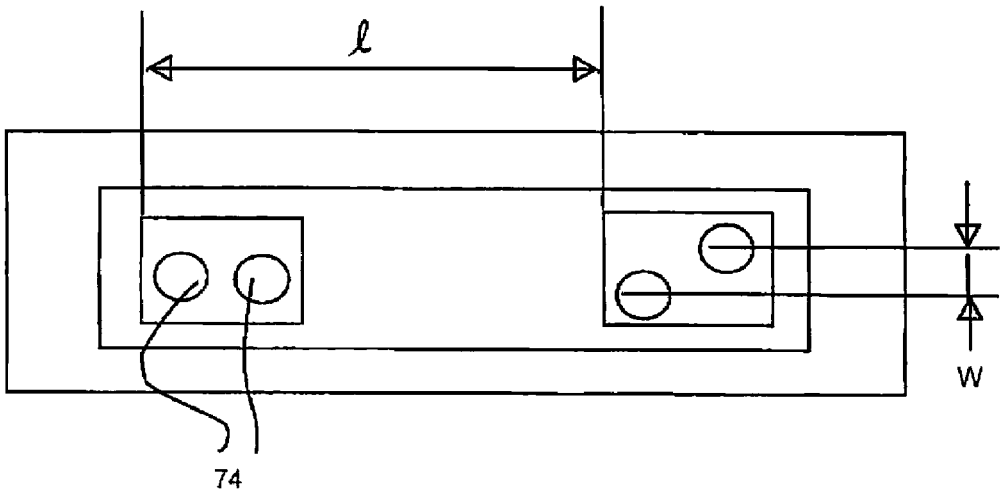
FIG. 5 is a schematic plan view showing the width and length limits of the pressure applying member movement.
Figure 6:
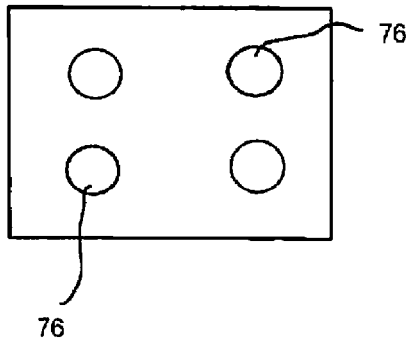
FIG. 6 is a plan view of the pressure applying member having four moving massage bumps.
Figure 7:
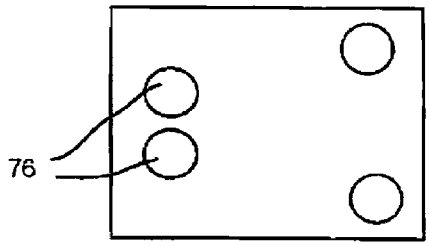
FIG. 7 is a view similar to FIG. 6 but showing that the massage bumps are moved up to the width limit.

The pressure applying member 20 includes one or more movable massage bumps that protrude toward the patient, and the movement of the massage bumps follow the predetermined width curve. In FIGS. 4 and 5, two movable massage bumps 74 are provided. In FIGS. 6 and 7, four movable massage bumps 76 are provided.

Figure 8:
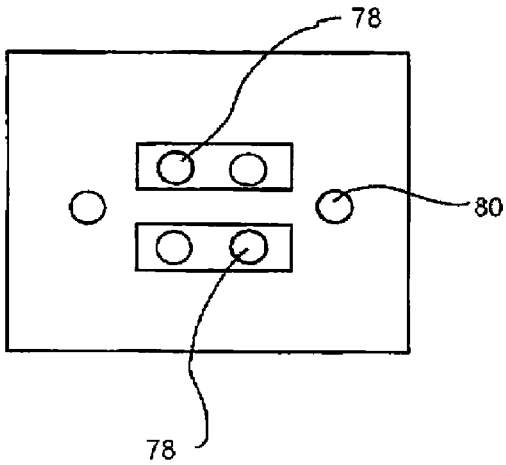
FIG. 8 is a plan view of the pressure applying member having four moving massage bumps and two stationary center massage bumps.
Figure 9:
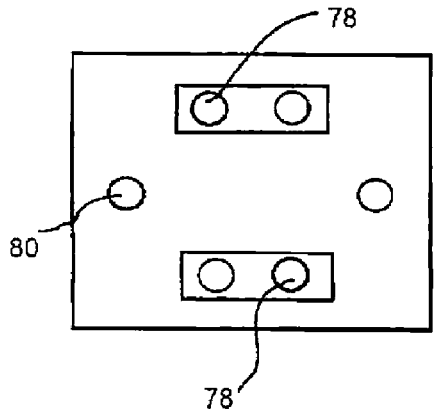
FIG. 9 is a view similar to FIG. 8 but showing that the moving massage bumps are moved up to the width limit.
Figure 22:
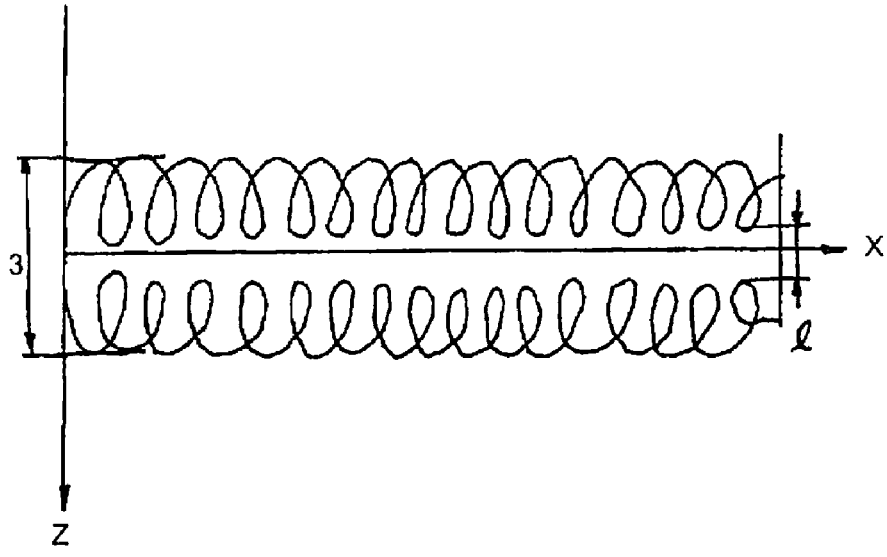
FIG. 22 is a graph showing two curves that indicate the movement of the massage bumps of the pressure applying member in XZ plane, and the curves have a shape of a two-dimensional coil and are parallel to each other.

The pressure applying member 20 may further include one or more fixed massage bumps. In FIGS. 8-10, four movable massage bumps 78 and two fixed massage bumps 80 are provided. The movable massage bumps 78 are move in pairs, and the fixed massage bumps 80 are lower than the movable massage bumps 78 as shown in FIG. 10. The movable massage bumps 78 are positioned symmetrical to the center of the pressure applying member 20, and the movement of the massage bumps 78 forms two width curves that are parallel to each other. FIG. 20 shows that the two width curves are sine waves, and FIG. 22 shows that the two width curves have a shape of a two-dimensional coil.

Figure 24:
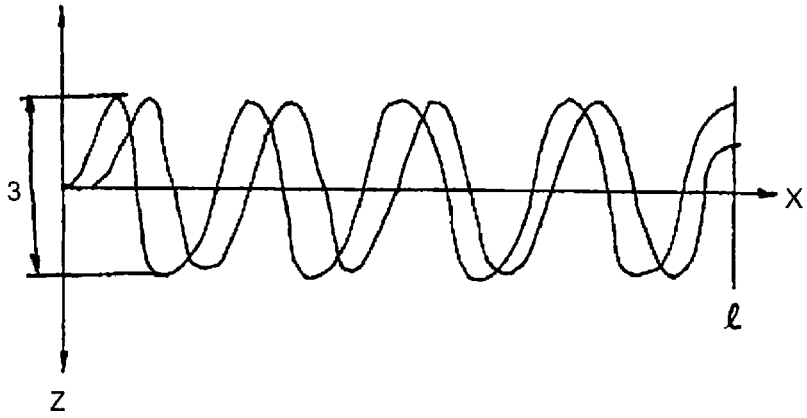
FIG. 24 is a graph showing two curves that indicate the movement of the massage bumps of the pressure applying member in XZ plane, and that movement of one of the massage bumps forms a first sine wave and movement of the other of the massage bumps forms a second sine wave that is spaced from the first sine wave by the distance between the two massage bumps.
Figure 25:
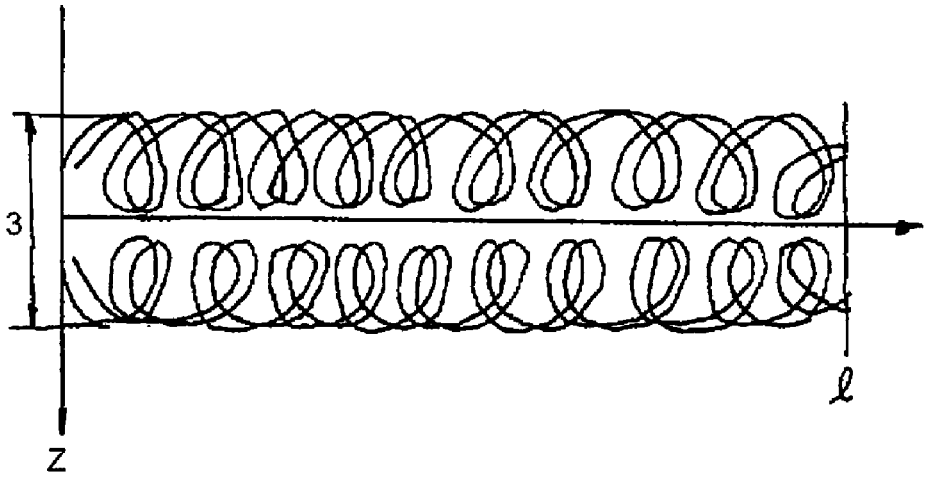
FIG. 25 is a graph showing four curves that indicate the movement of the massage bumps of the pressure applying member in XZ plane, and that movement of two massage bumps in one side forms two coils that are spaced from each other by the distance between the two massage bumps, and that movement of two massage bumps in the other side also forms two similar coils.

FIG. 19 shows that the movement of two massage bumps 74 follow the same width curve. Alternatively, as shown in FIGS. 24 and 25, the width curves followed by two longitudinally adjacent massage bumps are spaced by the distance between the two longitudinally adjacent massage bumps.

Figure 29:
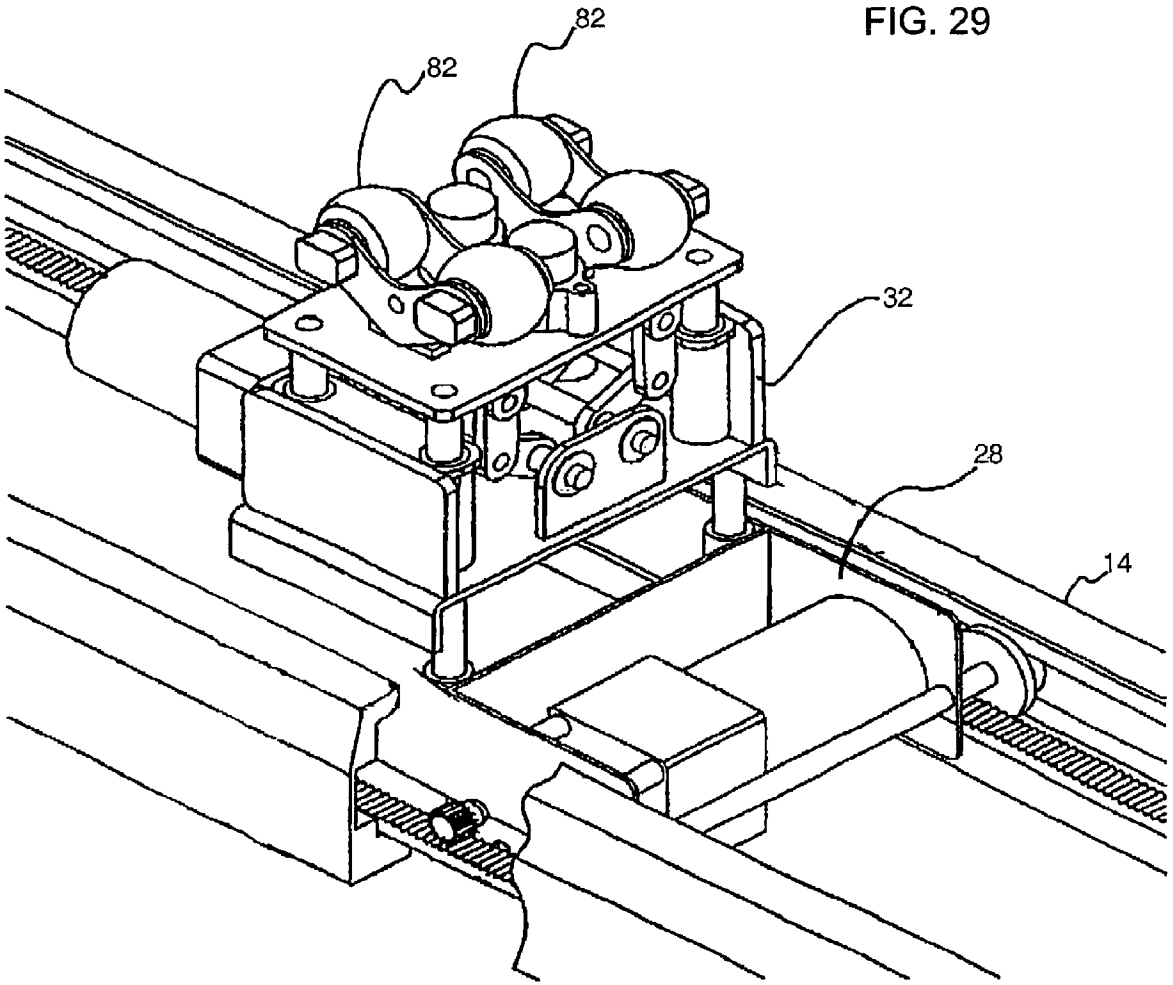
FIG. 29 is a perspective view showing an embodiment of the apparatus.

FIG. 29 shows an example of the massaging apparatus 10. The first axis actuator 28 is movable longitudinally along the platform 14, and the second axis actuator 32 move the massage bumps 82 up and down. The movable massage bumps 82 are wheels.

Figure 23:
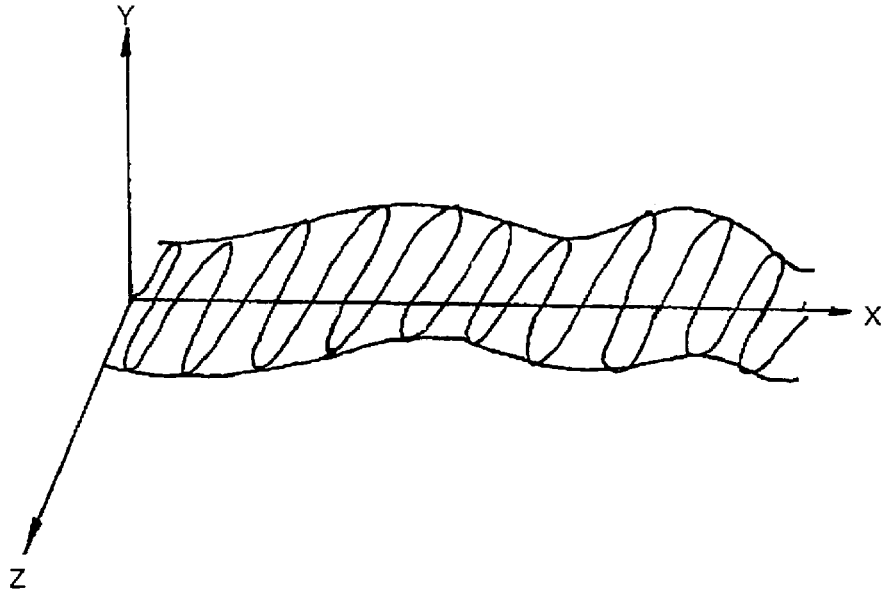
FIG. 23 is a graph showing a curve that indicates the movement of the massage bumps of the pressure applying member in XYZ space.

In FIG. 10, the movable massage bumps 78 are spheres. FIG. 23 shows that the coaxial curve and the width curve form a massage surface which the pressure applying member 20 follows.

Figure 26:
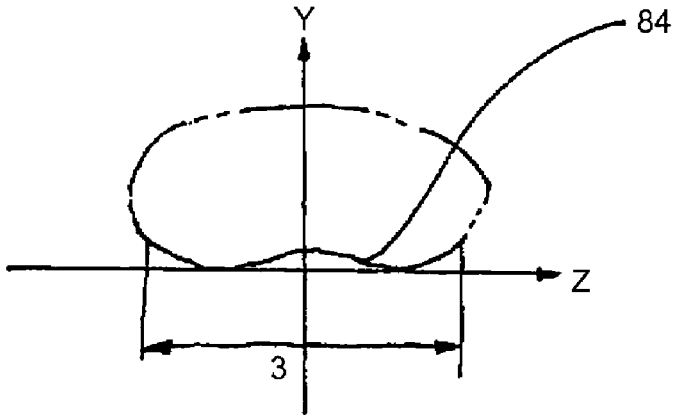
FIG. 26 is a graph showing a curve that indicates the movement of the massage bumps of the pressure applying member in YZ plane, and the curve follows backside contour of a patient.

FIG. 26 shows that the width curve 84 follows the body contour of the patient.

The body contour of the patient is measured by measuring the second axis Y coordinate of the pressure applying member 20 while the pressure applying member 20 is moved along the third axis Z at a constant speed at a given first axis X coordinate. The pressure applying member 20 is moved toward the patient in the direction of the second axis Y until the pressure applied on the patient by the pressure applying member 20 reaches a threshold. A curve formed by the measured second axis Y coordinates and the corresponding third axis Z coordinates is memorized in the microprocessor 26.

Figure 30:
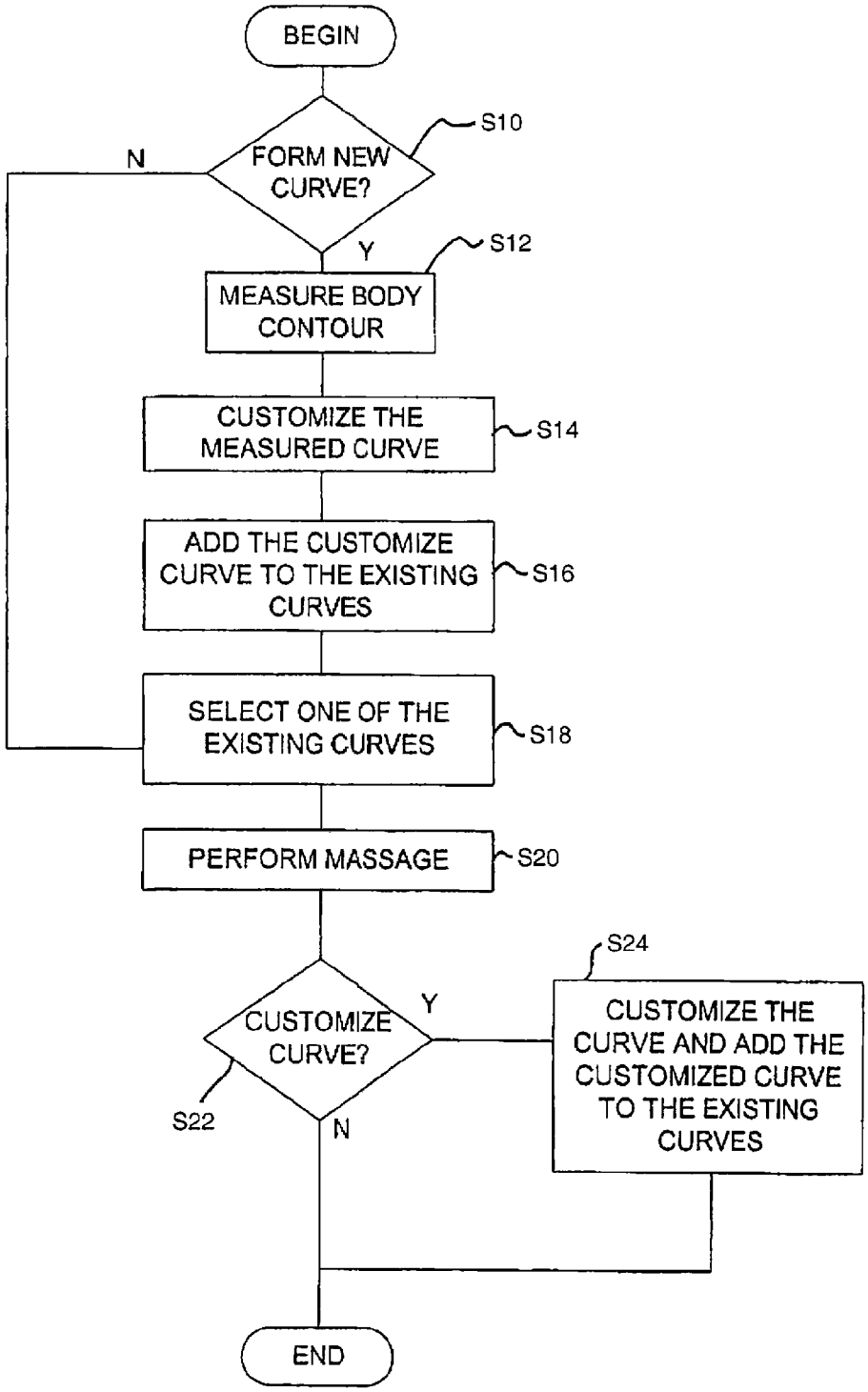
FIG. 30 is a flow chart showing the method for human body massaging.

As shown in FIG. 30, a method for massaging the body of a patient according to the present invention starts with a step S10 of asking the patient or the user whether to form a new curve.

If the answer is yes in step S10, the process goes to step S12, in which the body contour of the patient is measured. Then the process goes to step S14, in which the user can customize the measured curve. Then the process goes to step S16, in which the customized curve is memorized in the microprocessor 26. That is, the customized curve is added to the existing curves stored in the microprocessor 26. Then the process goes to step S18, in which the user is asked to select a massaging curve.

If the answer is no in step S10, the process goes directly to step-S18.

When a massaging curve is selected in step S18, the process goes to step S20, in which the pressure applying member 20 is moved along the longitudinal stroke. Specifically, the step S20 includes moving the pressure applying member 20 forward from the first end 16 to the second end 18, moving the pressure applying member 20 backward from the second end 18 to the first end 16, and repeating the forward moving step and the backward moving step.

Then in step S22, the user is asked whether to customize the massaging curve performed in step S20, and if the answer is yes, the curve is customized by the user in step S24, and stored in the microprocessor 26.

During step S22, the movement of the pressure applying member 20 in the second axis Y direction is stopped when the pressure applied by the pressure applying member 20 reaches a massage pressure threshold. The massage pressure threshold is adjustable by the user. In this way, excess displacement of the pressure applying member, which might cause pain to the user, is prevented, and the user can adjust the intensity of massaging.

In step S12, the second axis Y coordinate of the pressure applying member 20 is measured while the pressure applying member 20 is moved along the first axis X at a constant speed. The pressure applying member is moved toward the patient in the direction of the second axis Y until the pressure applied on the patient by the pressure applying member reaches a threshold. The patient can adjust the threshold.

In step S16, the curve formed by the measured second axis Y coordinates and the corresponding first axis X coordinates is memorized.

In step S18, the curve includes the memorized curve in step S16. The temperature of the pressure applying member is controlled as a third function of the first axis coordinate in step S20.

A massage therapy cycle consists of a plurality of coaxial curves. Initially, the coaxial curve is the curve following the backside contour of the patient for a few curves of the forward and backward moving steps, and then the coaxial curve includes acupressure sections. The acupressure sections include linear acupressure movement, or convex acupressure movement or both. The patient can add or remove acupressure sections along the first axis X in step S24.

Although the invention has been described in considerable detail, other versions are possible by converting the aforementioned construction. Therefore, the scope of the invention shall not be limited by the specification specified above.

What is claimed is:

1. A method for massaging the body of a patient lying on a horizontally leveled upper surface portion of a lie-down massager which includes a pressure applying member, comprising:

reciprocating the pressure applying member between a first end and a second end of the upper surface portion in accordance with a predetermined longitudinal stroke of the pressure applying member; and the predetermined longitudinal stroke coordinating along a first axis and a second axis in concurrence with the reciprocation so that the pressure applying member moves to follow a predetermined coaxial curve defined by the first axis and the second axis and to follow a predetermined width curve defined by the second axis and a third axis perpendicular to the first axis and the second axis, wherein the coaxial curve is selected from a plurality of teeth waves, parabolic waves, sinusoidal waves, and roller waves, wherein the pressure applying member comprises one or more movable massage bumps that protrude toward the patient, and the massage bumps move to follow the predetermined width curve, wherein the first axis is parallel to the upper surface portion, wherein the second axis is perpendicular to the first axis.

2. The method of claim 1, wherein the waves each starts anew per a predetermined distance along the first axis.

3. The method of claim 1 wherein the coaxial curve includes a plurality of convex portions.

4. The method of claim 3 wherein the movement of the pressure applying member along each of the convex portions repeats a predetermined number of times, wherein the waves each starts anew per a predetermined distance along the first axis.

5. The method of claim 1 wherein the coaxial curve is divided into a plurality of discrete sections, wherein the pressure applying member selectively applies pressure to the patient at the discrete sections.

6. The method of claim 1 wherein during the coordinating step, the movement of the pressure applying member along the second axis is stopped when the pressure by the pressure applying member reaches a massage pressure threshold, wherein the massage pressure threshold is adjustable.

7. The method of claim 1 wherein the pressure applying member is heated to a predetermined temperature.

8. The method of claim 1, wherein the pressure applying member further comprises one or more fixed massage bumps.

9. The method of claim 1, wherein the massage bumps are formed in one or two pairs positioned symmetric to each other at the center of the pressure applying member, wherein the massage bumps move relative to each other to form two width curves parallel to each other.

10. The method of claim 1, wherein the width curve follows the body contour of the patient.

11. A method for massaging the body of a patient lying on a horizontally leveled upper surface portion of a lie-down massager which includes a pressure applying member, comprising:

measuring a body contour of the patient to read a body line abutting with the upper surface portion;

reciprocating the pressure applying member between a first end and a second end of the upper surface portion in accordance with a predetermined longitudinal stroke of the pressure applying member, wherein the longitudinal stroke is customized in accordance with the read body line; and the predetermined longitudinal stroke coordinating along a first axis and a second axis in concurrence with the reciprocation so that the pressure applying member moves to follow a predetermined coaxial curve defined by the first axis and the second axis and to follow a predetermined width curve defined by the second axis and a third axis perpendicular to the first axis and the second axis, wherein the coaxial curve is selected from a plurality of teeth waves, parabolic waves, sinusoidal waves, and roller waves, wherein the pressure applying member comprises one or more movable massage bumps that protrude toward the patient, and the massage bumps move to follow the predetermined width curve, wherein the first axis is parallel to the upper surface portion, wherein the second axis is perpendicular to the first axis.

12. The method of claim 11 wherein the measuring step reads a value of the second axis relative to location of the pressure applying member which moves along the first axis at a constant speed, wherein the pressure applying member moves upward along the second axis until the pressure on the patient by the pressure applying member reaches a threshold.

13. The method of claim 11, wherein the waves each starts anew per a predetermined distance along the first axis.

14. The method of claim 11 wherein the coaxial curve includes a plurality of convex portions.

15. The method of claim 14 wherein the movement of the pressure applying member along each of the convex portions repeats a predetermined number of times, wherein the waves each starts anew per a predetermined distance along the first axis.

16. The method of claim 11 wherein the coaxial curve is divided into a plurality of discrete sections, wherein the pressure applying member selectively applies pressure to the patient at the discrete sections.

17. The method of claim 11 wherein during the coordinating step, the movement of the pressure applying member along the second axis is stopped when the pressure by the pressure applying member reaches a massage pressure threshold, wherein the massage pressure threshold is adjustable.

18. The method of claim 11 wherein the pressure applying member is heated to a predetermined temperature.

19. The method of claim 11, wherein the pressure applying member further comprises one or more fixed massage bumps.

20. The method of claim 11, wherein the massage bumps are formed in one or two pairs positioned symmetric to each other at the center of the pressure applying member, wherein the massage bumps move relative to each other to form two width curves parallel to each other.

21. The method of claim 11, wherein the width curve follows the body contour of the patient.

22. The method of claim 11, wherein the body contour of the patient is measured by coordinating the second axis and the third axis, wherein the pressure applying member moves along the third axis at a constant speed relative to the first axis, wherein the pressure applying member moves toward the patient in the direction of the second axis until the pressure on the patient by the pressure applying member reaches a threshold.

23. The method of claim 22 wherein the threshold is adjustable.

24. The method of claim 11, wherein the coaxial curve and the width curve serve to form a massage surface along which the pressure applying member follows.

25. The method of claim 11 wherein the coaxial curve includes an acupressure wave incorporating a linear acupressure movement, a convex acupressure movement or both.

26. The method of claim 11, wherein the width curve has a wave of a two-dimensional coil.

* * * * *